United States Patent [19]

Patterson et al.

[11] 4,082,589

[45] Apr. 4, 1978

[54] CREEL LOADING, CUTTING, AND SPLICING SYSTEM FOR SHEET MATERIAL

[75] Inventors: Thomas K. Patterson, Dublin; William O. Mitchell; Donald H. Smith, both of Vidalia; John P. Hunter, Jr., Dunwoody, all of Ga.

[73] Assignee: Oxford Industries, Inc. Alantic, Ga.

[21] Appl. No.: 766,240

[22] Filed: Feb. 7, 1977

[51] Int. Cl.[2] ..... B65H 19/22; B65H 19/26

[52] U.S. Cl. ..... 156/98; 156/159; 156/266; 156/507; 226/29; 242/57; 242/58.5; 242/59; 242/186; 356/167

[58] Field of Search ..... 242/57, 57.1, 58.1, 242/58.4, 58.5, 59, 186, 56; 226/29, 30; 355/50, 51, 40, 77; 156/98, 159, 266, 507; 33/17 R; 356/156, 167

[56] References Cited

U.S. PATENT DOCUMENTS

| | | | |
|---|---|---|---|
| 1,972,536 | 9/1934 | Rohrdanz | 156/507 |
| 3,540,830 | 11/1970 | Dicanio | 33/17 |
| 3,552,851 | 1/1971 | Gross | 355/40 |
| 3,768,904 | 10/1973 | Rodek | 226/29 X |
| 3,834,813 | 9/1974 | White | 355/77 |
| 3,933,565 | 1/1976 | Printz et al. | 156/266 |

OTHER PUBLICATIONS

"Tensionless Inspection System" Bond Transmission & Controls, Inc., Greenville, S. C.

"Sunco Measuring, Inspecting, and Rewinding Machine" *Sunbrand Technical Bulletin*, Atlanta, Ga. 3-72.

*Primary Examiner*—David Klein

*Assistant Examiner*—Jerome W. Massie

*Attorney, Agent, or Firm*—Jones, Thomas & Askew

[57] ABSTRACT

Sheet material is moved along its length from a supply to a take-up spool and the material is inspected as it is moved. A garment pattern image is projected on and is moved with the material. The operator determines where the material is to be cut either from the length accumulated on the take-up spool or from the image projected on the material, and if a flaw in the material is detected, the operator determines if the flaw should be removed by identifying the pattern part in the garment from the image projected on the material where the flaw will appear. If the flaw is to be removed, the operator cuts the flaw out and splices the cut ends of material together at splice marks in the image projected on the material. The spools loaded with sheet material with this procedure are loaded in a creel, and the ends of the sheets of material from the spools in the creel are aligned in a vertically stacked arrangement and moved to a cutting apparatus where the garment pattern is cut in the stacked sheets of material.

13 Claims, 2 Drawing Figures

CREEL LOADING, CUTTING, AND SPLICING SYSTEM FOR SHEET MATERIAL

BACKGROUND OF THE INVENTION

In the manufacture of garments, it is customary to spread sheets or plies of material in long lengths and in several vertically stacked layers on long cutting tables, to spread a long sheet of pattern paper over the top of the stacked layers of material, and to cut through the stacked material with a band saw cutter or other cutting tool. The spreading of the material on the long cutting tables requires a substantial amount of time, and the cutting table occupies a large floor space in the cutting room. The worker usually spreads out the long paper pattern on the bare cutting table and marks the splice locations indicated on the paper pattern directly on the edge of the cutting table, and then rolls up his paper pattern. The fabric is then usually received in a large roll, the roll is mounted on a moving spindle, and the spindle is then moved up and down the length of the cutting table to pay out the material onto the cutting table. When the worker gets to the far end of the table he reverses the process and spreads the material in the opposite direction. After many layers of material have been spread in this manner, usually 36 or 48 layers, the worker then respreads the paper pattern on top of the vertically stacked layers of material and begins the cutting process.

While a large number of layers of material can be cut with this procedure, the accuracy of the cut made by the operator decreases as the stacked material increases in height. Moreover, the pattern pieces cannot intersect with band saw cutting since the typical band saw cutting techniques usually fail on a "tangential" cut. Furthermore, the operator can usually cut the larger pattern pieces with the amount of accuracy desired, but the smaller pattern pieces, such as cuffs and collars, usually cannot be cut with the desired degree of accuracy, since accuracy in these smaller pieces is more critical. Thus, the operator usually cuts the outside of the pattern marking for the smaller garment parts and these parts are subsequently moved to a die cutter or "clicker" where the large stack of pattern parts are subdivided into smaller stacks and cut with a die. Even with a die cut the accuracy of the cut made in the fabric is not always acceptable, and the overcutting at the cutting table and subsequent die cutting procedure results in a substantial amount of wasted material.

Water jet cutting and other recently developed cutting techniques are now available and capable of cutting cloth material with more accuracy than the previously known band saw cutting and other prior art techniques. For example, water jet cutting can make better tangential cuts than band saw cutting, and the smaller garment parts such as collars and cuffs can be more accurately and more expediently cut. One of the problems with water jet cutting and other newer cutting techniques is that some of the new systems are not adaptable to the long cutting table, where the cutting instrument is required to be moved long distances with respect to the stack of material.

SUMMARY OF THE INVENTION

Briefly described, the present invention comprises a creel loading and cutting system wherein sheet material is moved along its length from a supply, such as from a large bolt of material, and moved to a take-up spool.

The sheet material is cut in short lengths, such as 20 to 40 yards, and each cut sheet is wound on a separate spool. As the sheet material moves from its supply it is inspected by an operator to determine if flaws are present in the material. An image can be projected on the sheet material, and the projected image is moved in unison with the sheet material. The image comprises a garment pattern and splice marks and other indicia pertinent to the system, and when a flaw in the sheet material is detected, the projected image and flaw are compared to determine where the flaw will ultimately appear in the pattern to be cut from the sheet material. If the flaw appears at a harmless or insignificant location in the ultimate pattern to be cut from the material, the operator allows the flaw to remain in the material and to move on to the take-up spool; however, if the flaw must be removed from the sheet material, the operator can mark the sheet material at its edge so that the flaw can be located and removed later and the operator resumes the spool winding of the material, or the operator can cut the material and splice the cut ends. In the splicing procedure the operator reverses the movement of sheet material and projected image until a splice mark appears in the projected image on the sheet material, and the operator then marks the splice mark positions on the sheet material. The operator cuts across the sheet material on opposite sides of the flaw and then splices the cut ends of the sheet material at the splice marks on the sheet material and resumes the winding and inspecting procedure.

After a plurality of spools of sheet material have been formed with the foregoing procedure, the spools are loaded into a creel. The ends of the sheet material from the spools are aligned with one another in a vertically stacked relationship on a conveyor surface, and the stacked ends are conveyed from the creel to a cutting station. A cutter, such as a water jet cutter, functions to cut a garment pattern in the stacked sheets of material. When the cutting mechanism has completed a short length of the pattern cutting, the stacked sheets of material are indexed further on the conveying surface from the creel so as to intermittently provide uncut material from the creel to the cutting station.

Thus, it is an object of this invention to provide a creel loading and cutting system wherein short lengths of sheet material are cut from a supply of material and wound on spools, the spools are loaded into a creel, the ends of the sheets of material from the spools in the creel are aligned in a vertically stacked relationship with respect to one another and moved to a fabric cutting apparatus.

Another object of this invention is to provide a system in which sheet material can be moved along its length from a source of supply and visually inspected for the presence of flaws during the movement, the flaws are detected and marked or removed, and, if removed, the cut ends of the sheet material are spliced together at appropriate splice locations on the sheet material, and the sheet material is subsequently cut to length and accumulated on a spool.

Another object of this invention is to provide a system for projecting an image on moving sheet material, wherein the image projected includes a garment pattern and splice marks in the pattern, and wherein the projected image is used to control cutting, marking or other steps performed on the sheet material.

Other objects, features and advantages of this invention will become apparent upon reading the following specification, when taken in conjunction with the accompanying drawing.

DETAILED DESCRIPTION

Figure 1:
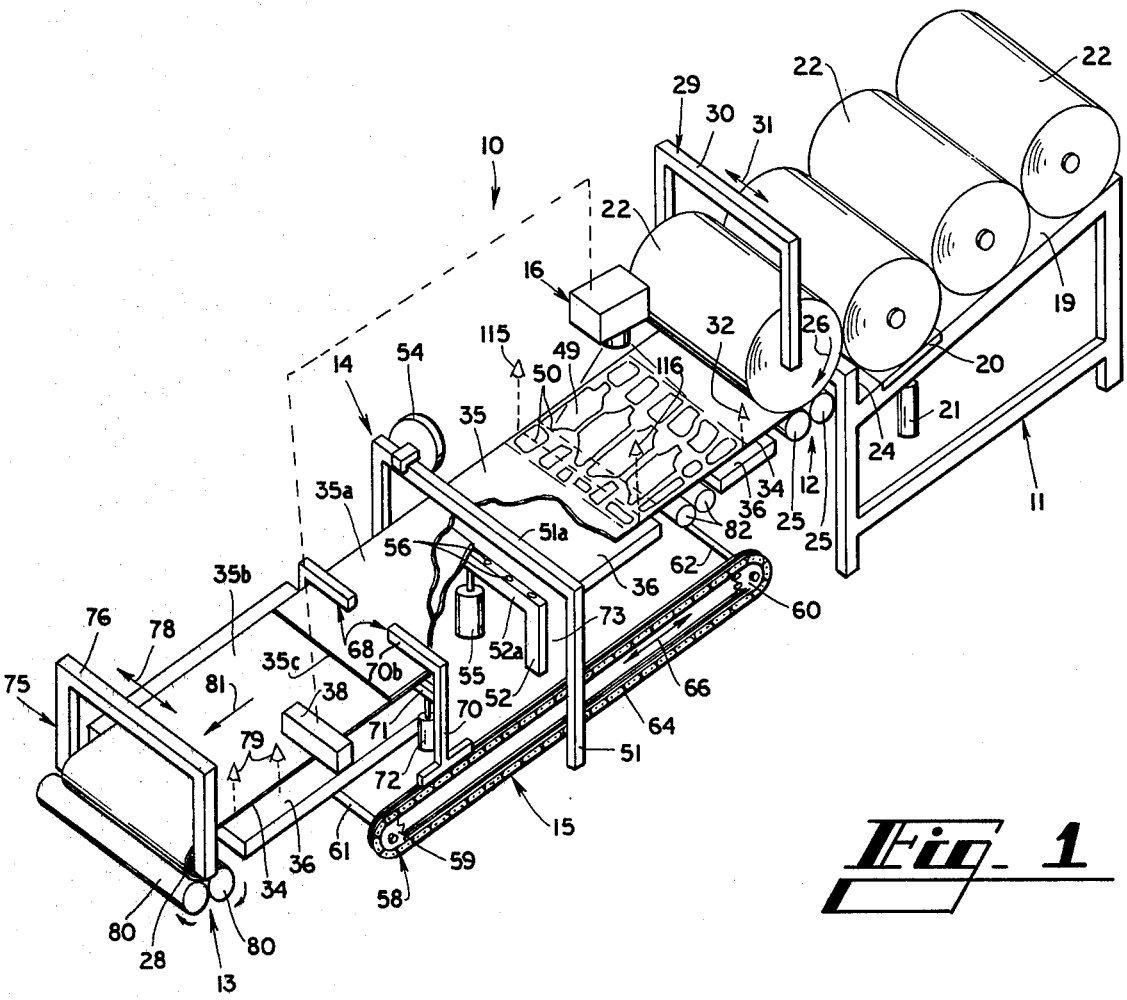
FIG. 1 is a schematic perspective illustration of a spool loading system, with portions of the sheet material removed.

As shown in FIG. 1, the spool loading system 10 comprises material supply means 11, material feed means 12, spool take-up means 13, cutting means 14, material transfer means 15, and image projection means 16. The material supply means 11 comprises a framework 18 that includes an inclined ramp 19, a pivotal platform 20 and air operated ram assembly 21. Large bolts of cloth or similar sheet material 22 are loaded on the framework 18 and moved down the inclined surface 19 to the end abutment 24. When a bolt of cloth is resting against the end abutment 24 it also rests upon the tilting platform 20. When a bolt of cloth is to be transferred off the material supply means 11, fluid pressure communicates with rams 21 to cause the tilting platform 22 to lift the lowermost bolt 22 upwardly over the abutment 24 onto the material feed means 12.

Material feed means 12 comprises a pair of feed rollers 25 which are driven in unison by a reversible electric motor (not shown) so that their upper surfaces cause the bolt of material resting on the feed rollers 25 to rotate in the direction indicated by arrow 26 to feed out the free end of the sheet material from the lower portion of the belt. The free end of the sheet material eventually reaches spool take-up means 13 where it is wound upon spool 28. The feed rollers 25 can be driven by the motor (not shown) in either direction so that the free end of the material from the bolt 22 resting on the feed rollers 25 can be paid out or retracted.

Material feed means 12 also includes bolt shifting mechanism 29 that includes an inverted U-shaped frame 30 that is movable in opposite horizontal directions as indicated by arrows 31. The U-shaped frame 30 is driven by an air operated ram (not shown) or equivalent shifting system, and the frame 30 can be shifted in small lateral increments or in long distances, so as to align an edge of the material paying out from a bolt 22 on the feed rollers 25 in an alignment detector, or to shift a bolt 22 or any remaining portion thereof laterally off the feed rollers 25. Photoelectric cells 32 or a similar edge detecting system detects the presence or absence of an edge of the cloth as the cloth pays out from a bolt 22 and feed rollers 25 to determine the location of the edge of the cloth along the desired feed path, and the U-shaped frame 30 of the bolt shifting means 29 shifts the bolt present on the feed rollers 25 in small lateral increments in response to the edge detecting system so that the edge 34 of the sheet material is always properly positioned in the spool loading system 10.

The free end of the sheet material 35 extends from the bolt 22 across the segmented work table 36 and beneath the image projection means 16. Image projection means 16 also includes a length measuring apparatus 38 which can be positioned at various locations along the path of movement of the sheet material 35 across the segmented work table 36. The image projection means 16 includes a continuous reel of transparent film or other medium and a light which projects the image from the film onto the moving sheet material 35. The transparent film has a garment pattern imposed thereon, including splice marks in the pattern, and the continuous film is driven by the length measuring apparatus 38 so that the image moves in unison with the movement of the sheet material 35, at the same velocity as the velocity of the sheet material 35. The image shown in FIG. 1 is a garment pattern 49 with splice marks 50. The length measuring apparatus 38 can be of various designs, including the conventional design that utilizes counter-rotating rollers such as Trumeter Model 70'*s*' manufactured by True Motor, Inc. The driving connection between the length measuring apparatus 38 and the continuous length of film (not shown) of the image projection means causes the projected image to move in unison with the sheet material, in either direction of movement of the sheet material, and the garment pattern projected on the sheet material is continuous, preferably with no gaps or overlaps in the projected pattern.

Cutting means 14 comprises a stationary U-shaped cutter support 51, vertically movable clamp 52 and disc cutter 54 mounted on the horizontal leg **51*a* of stationary cutter support 51. Pneumatic ram 55 moves the horizontal leg 52*a* of clamp 52 upwardly toward clamping relationship with the bottom surface of the horizontal leg 51*a* of the cutter support 51. A plurality of openings 56 are formed in the upper surface of the horizontal leg 52*a* of the clamp 52, and a partial vacuum is drawn in the clamp 52 by a compressor (not shown) so as to induce an air flow into the clamp 52 through the openings 56. When clamp 52 is moved in an upwardly direction by ram 55 toward engagement with the stationary cutter support 51, the sheet material 35 is clamped between the upper horizontal leg 52*a* of the clamp and the upper horizontal leg 51*a* of the cutter support 51, and disc cutter 54 is moved along the length of the horizontal leg 51*a* of the cutter support 51 and its disc (not shown) functions to cut across the length of the sheet material 35. The portion 35*a* of the sheet material extending back from the spool 28 at the spool take-up means 13 to the cutting means 14 is then held on the top surface of the horizontal leg 52*a* of the clamp 52 by the vacuum drawn through the openings 56 of the clamp, so that when the ram 55 opens the clamp, the cut end of the sheet material 35*a*** will be retained at the clamp by the vacuum.

Material transfer means 15 comprises a chain drive 58 (only one shown) on opposite sides of and below the surface of the segmented work table 36, each of which includes sprockets 59 and 60, and a continuous chain 64. Connecting rods 61 and 62 connect the sprockets of the chain drives 58, so that the chains 15 are driven in unison, in back and forth directions as indicated by arrows 66 by a fluid actuated reversible drive system (not shown). Clamps 68 are mounted on chains 64, and each clamp 68 includes L-shaped upper clamp bar 70 which has its upright leg 78 mounted on chain 64 and its horizontal leg **70*b* extending over the sheet material 35. Lower clamp bar 71 is vertically movable under the influence of pneumatic ram 72 toward and away from the under surface of the horizontal leg 70*b* of the clamp bar 70 and functions to grip the sheet material 35 against the lower surface of the horizontal leg 70*b* of the clamp bar 70. The material clamps 68 operate in unison so as to grip and release the sheet material 35 in unison. The size and shape of the clamps 68 are compatible with the spaces 73 between the cutter support 51 and the vertically movable clamp 52 when the clamp is open, so that the clamps 68 can move through the cutting means 14 when moving as indicated by the arrows 66**.

Spool take-up means 13 also includes a bolt shifting means 75 which comprises an inverted U-shaped frame 76 movable horizontally as indicated by arrows 78, either in small lateral increments or in longer distances, to adjust the position of the edge 34 of the sheet material 35, or to completely remove a spool 28 and its accumulated sheet material from the spool take-up means 13. Photoelectric cells 79 or a similar edge detecting system detects the presence or absence of the edge 34 of the sheet material and functions to actuate the spool shifting means 75, through the actuation of a pneumatic ram (not shown). Rollers 80 of the spool take-up means 13 are rotated in unison by a reversible motor (not shown) to cause the spool 28 and the accumulated sheet material to rotate and further accumulate the sheet material passing through the spool loading system.

While the sheet material 35 usually moves in the direction indicated by arrow 81 from the material feed means 12 to the spool take-up means 13, there are times when it is desirable to move the sheet material in the opposite direction from the spool take-up means 13, either by the feed rollers 25 or by other sheet material retraction means. Counter-rotating rollers 82 are positioned just beneath the upper plane of the segmented work table 36, and the free end of a length of sheet material **35*b* can be inserted between the retractor rollers 82, the rollers rotated to draw the material from the spool take-up means 13, to move the sheet material in the direction opposite to the arrow 81**.

Figure 2:
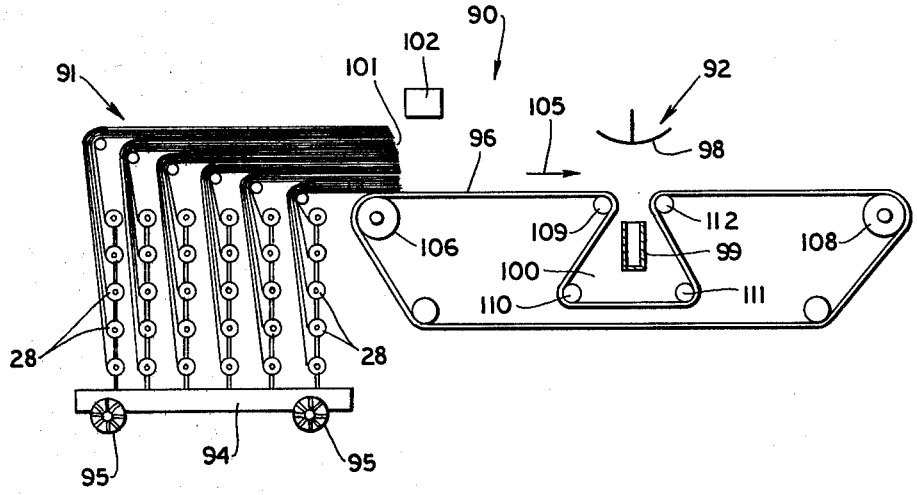
FIG. 2 is a schematic side elevational view of a creel and pattern cutting system.

As shown in FIG. 2, the creel and cutting system 90 includes a portable creel 91 and cutting system 92. The portable creel 91 comprises a platform 94 mounted on wheels 95 and a plurality of spools 28 are supported in the creel 91 by a framework (not shown) extending upwardly from the platform 94. The spools 28 are taken from the spool loading system 10 and mounted in the portable creel 91 and the free end of the sheet material on each spool is moved upwardly to the upper portion of the creel and then laterally to the edge of the creel. After the creel 91 has been loaded, the creel is moved to the cutting system 92.

Cutting system 92 comprises a water jet cutter that includes a conveyor surface 96 formed by a conveyor belt, a water jet emission system or nozzle 98, a water receptacle 99, and belt recess 100. The ends 101 of the sheet material extending from the spools 28 are arranged in aligned, vertically stacked relationship with respect to one another and fed to the conveyor belt 96. A clamp block 102 compresses the ends of the sheet material onto the conveyor belt 96 and the conveyor belt 96 is then actuated to bring the ends of the sheet material and clamp across the upper surface of the conveyor assembly in the direction indicated by arrow 105. The conveyor belt is driven by one of its larger rollers 106 or 108 and by an electric motor, and the continuous belt moves from the first larger roller 106 about first recess roller 109, lower recess rollers 110 and 111 and then back up about recess roller 112 toward the second larger roller 108. After a length of the stacked sheets of material has been moved from the portable creel 91 to the cutting system 92, the water jet cutter 98 is actuated. The water jet nozzle 98 causes a high velocity stream of water to be projected in a downward direction into the recess 100 and into the receptacle 99, causing the sheets of material to be severed. The water jet nozzle 98 is movable back and forth across the material and is also movable along the length of the material. Also, the recess 100 and receptacle 99 are movable along the length of the material so that the high velocity water jet never contacts the conveyor belt 96, and so that the water jet is movable in both X and Y directions.

When the cutting of the stack of sheet material on the conveyor belt 96 has been completed, the conveyor belt is indexed so as to bring a new length of stacked material from the portable creel 91 onto the conveyor surface, so that the cutting procedure can be resumed.

Referring to FIG. 1, when the spool loading system is operated, the operator causes feed rollers 25 to feed the free end of sheet material from a bolt 22 on the feed rollers 25 and the operator threads the leading edge of the sheet material through the system and attaches the end to the spool 28. If the free end of the sheet material is not square, the operator places the free end of the sheet material in the cutting means 14, by placing the free end of the material on the upper surface of the horizontal leg **52*a* of the movable clamp 52, actuates the clamp so that it moves upwardly into contact with the horizontal leg 51*a* of the cutter support 51, and then moves the disc cutter 54 across the upper horizontal leg 51*a* of the cutter support, which cuts and squares off the leading end of the sheet material. When the operator brings the sheet material to the spool 28, the operator threads the sheet material through the length measuring apparatus 38, so that the portion of the sheet material extending between the length measuring apparatus 38 and the spool 28 is measured, which causes a corresponding movement of the film (not shown) in the image projection means 16. After the material has been drawn taut by the manual rotation of the spool 28, the spool take-up means 13 and the material feed means 12 are operated in unison to begin the feeding of the sheet material from the bolt 22 to the spool 28. As the material moves along its length from the bolt 22, the operator visually inspects the material for the presence of flaws. If no flaws are observed, the operator continues the feeding of material until an indication is received from the length measuring apparatus 38 which alerts the operator to the fact that the proper amount of material is present on the spool 28. The operator terminates the feeding of the material, marks the location on the material where the material should be cut, and by the manipulation of feed rollers 25 and spool rollers 80, positions the marked portion of the material at the cutting means 14. The material tranfer means 15 is moved on its chain drive 58, from left to right in FIG. 1, to the bolt side of the cutting means 14, and its clamps 60 are closed and grip the sheet material 35. The movable clamp 52 of the cutting means 14 is then closed in an upward direction against the stationary cutter support 51 and disc cutter 54 is then drawn across the upper horizontal leg 51*a* of the cutter support 51, which cuts the sheet material. The clamp 52 is opened and rollers 80 of the spool take-up means 13 are again actuated to draw the trailing end of the sheet material onto spool 28, and then the inverted U-shaped frame 75 is shifted in a lateral direction to eject the filled spool 28 from the system. The material transfer means 15 is actuated so that its clamp 68 brings the now cut leading end of the sheet material through the cutting means toward the spool take-up means 13. When the leading end of the sheet material approaches the spool take-up means, the operator causes the clamps 68 of the material transfer means to release the sheet material, and the operator draws the free end of the sheet material on by hand to the new spool 28** and attaches the end to the spool. The system is now ready to repeat the previously described spool loading procedure.

If the operator detects a flaw in the sheet material during the spool loading procedure, the operator stops the movement of the sheet material through the spool loading system so that the flaw will appear at the image projection means 16, and the light of the image projection means is cut on so that the image of the garment pattern is projected by the projected onto the sheet material. If desired, the light of the image projection means can remain on so that the image is continuously projected onto the sheet material at all times. If the flaw in the sheet material occurs at a location in the projected pattern where it would not be detrimental to the garment which is to be produced from the sheet material, the operator may elect to resume the feeding process without removing the flaw from the sheet material; however, if the flaw must be removed from the sheet material, the operator proceeds with the splicing procedure as follows.

The sheet material is moved on through the cutting means 14 until the flaw moves just beyond the cutting means 14, where the cutting procedure is initiated. The material transfer means 15 remains on the spool side of the cutting means 14 and is actuated to clamp and hold the sheet material. The clamp 52 of the cutting means 14 is moved up into contact with the cutter support 51, and the disc cutter 54 is drawn across the sheet material and cuts behind the flaw. The clamp 52 is then moved down to open the clamp and the material transfer means 15 is then moved back through the cutting means 14, in the direction opposite to the direction indicated by arrow 81, to draw the flawed portion of the sheet material to the vicinity of the retraction rollers 82. The clamps 68 are then opened and the operator inserts the free end of the material extending rearwardly from the spool 28 between the counter-rotating retraction rollers 82, the rollers are driven by their reversible driving motor (not shown), whereupon the sheet material is retracted from spool 28. In the meantime, the length measuring apparatus 38 detects and measures the reverse movement of the sheet material from the spool 28 and causes a corresponding movement of the continuous film (not shown) in the image projection means 16, so that the pattern and its splice mark images are continuously moved in unison with the sheet material as it is being back-drawn through the retraction means 82.

When a splice mark image is projected on the sheet material, the operator stops the retraction of the sheet material and marks the material where the splice marks are projected. The operator then reverses the feed direction of the system, so that the splice marks made on the sheet material are brought to the cutting means 14, and the second splice mark (the splice mark closest to the bolt 22) is aligned in the cutting means 14, and the sheet **35*b* extending from the spool 28 is cut at one of the splice marks. The vacumn drawn through the movable clamp 52 of the cutting means 14 holds the now cut free end of the sheet material 35*b* extending back through the system from spool 28** at the clamp, so that when the cutting procedure has been completed and the clamp is opened, the free end of the sheet material remains at the clamp.

When the clamp 52 of the cutting means 14 has been opened, the material transfer means 15 is actuated to engage the free end of the sheet material **35*a* extending from the bolt 22 at the feed rollers 25 and to bring the free end from the bolt 22 on through the cutting means 14 a distance sufficient to have the leading end 35*c* positioned at the second splice mark on the sheet material 35*b*. The clamps 68 of the transfer means 15 are opened and the operator connects the leading end 35*c* of the sheet material 35*a* to the sheet material 35*b* at the second splice mark, by the use of staples, double-sided tape, or other conventional connecting means. In addition, the operator connects the trailing end of the sheet material 35*b* to the sheet 35*a*, by advancing the partially completed splice out from beneath the cutting means 14** and stapling, taping or otherwise connecting the end to the sheet.

After the splice has been completed, the operator resumes the normal operation of the spool loading system until the proper length of sheet material has been accumulated on the spool 28.

When the end of a bolt passes through the spool loading system, the bolt spindle is ejected from the feed rollers 25 by the bolt shifting means 29 and a new bolt 22 is loaded from the material supply means 11 onto the feed rollers 25. The operator must then splice the trailing end and leading end of the sheets of material together in a procedure similar to the fault splicing procedure previously described.

It is desirable to load the spools 28 with at least one of the edges of the sheet material in proper alignment on the spool so that the subsequent creel stacking and feed out from the creel can be performed without onerous alignment steps. Thus, photoelectric sensors 32 adjacent the feed rollers detect the position of an edge of the sheet material as the sheet material is being fed out and causes the bolt shifting means 29 to move in small increments and guide the edge of the material along the proper path. In a similar arrangement, the photoelectric sensors 79 adjacent the spool take-up means 13 also detect the position of the same edge of the sheet material as the sheet material is being accumulated on the spindle 28 and actuates the spool shifting means 75 in small increments to cause the spool 28 to take up the sheet material with its edge in proper alignment on the spindle.

In the event that it is desirable to detect the width of the sheet material being inspected, spliced and loaded through the spool loading system, additional photoelectric cells or other sensing means 115 and 116 can be positioned at opposite edges of the path of the sheet material to determine the presence or absence of the edges of the sheet material and to actuate an indication when the sheet material is less than a desired width. If the entire bolt of material is not wide enough, the bolt can be rewound and rejected for use in another pattern or for returning to the supplier. On the other hand, if only a short distance of a bolt of material is of insufficient width, the operator may decide to cut out the narrow portion of the sheet material with the previously described splicing procedures, just as if the narrow portion of the sheet material contained a flaw, and then splice together the portions of the sheet material that are of proper width.

While this invention has been described in detail with particular reference to a preferred embodiment thereof, it will be understood that variations and modifications can be effected within the spirit and scope of the invention as described hereinbefore and as defined in the appended claims.

We claim:

1. A process of cutting lengths of sheet material comprising moving sheet material along its length from a supply, projecting an image which includes splice positions on the sheet material and moving the projected image in timed relationship with the sheet material, and cutting the sheet material at locations on the sheet material which have splice positions projected thereon.

2. The process of claim 1 and wherein the step of cutting the sheet material at locations on the sheet material which have splice positions projected thereon comprises marking the sheet material at locations on the sheet material which have splice positions projected thereon, and cutting across the sheet material at the marks on the sheet material.

3. The process of claim 1 and wherein the step of projecting an image on the sheet material comprises projecting a garment pattern image on the sheet material with the splice positions present in the pattern.

4. The process of claim 1 and wherein the step of moving the projected image in timed relationship with the sheet material comprises continuously moving the projected image at the same velocity as the velocity of movement of the sheet material, and repeating the image on the sheet material as the sheet material continues to move.

5. The process of claim 1 and wherein the step of cutting the sheet material comprises simultaneously stopping the movement of the sheet material and stopping the movement of the projected image, marking the sheet material at a location where a splice position is projected on the sheet material, moving the sheet material to another location, and cutting across the sheet material at the marked location.

6. The process of claim 1 and further including a splicing process comprising the steps of moving the sheet material in a reverse direction and moving the projected image in a reverse direction until a pair of cut positions is projected on the sheet material, marking the sheet material at both of the cut positions, cutting across the sheet material at one of the marked cut positions, moving a new end of the sheet material along its length from the supply into overlapped relationship with the cut end of sheet material, and connecting the new end of sheet material to the cut end of sheet material at the other marked cut position adjacent the cut end of sheet material.

7. The process of claim 1 and further including a splicing procedure comprising inspecting the sheet material as the sheet material moves along its length from its supply, stopping the movement of the sheet material when a flaw is detected in the sheet material, cutting the flaw out of the sheet material, moving the sheet material and projected image in a reverse direction until a pair of splice positions are projected on the sheet material, marking the sheet material at the projected splice positions, cutting across the sheet material at one of the marked splice positions, moving a new end of sheet material from the supply into overlapped relationship with the cut end of sheet material, and connecting the new end of sheet material to the cut end of sheet material at the other marked splice position.

8. The process of claim 1 and further including the step of accumulating the lengths of cut sheet material on spools, and placing the spools in a creel.

9. In a process of forming lengths of sheet material, the steps of moving sheet material along its length from a supply, inspecting the sheet material as it moves along its length to detect flaws in the sheet material, moving a visual image projection medium in timed relationship with the movement of the sheet material, projecting a visual image from the visual image projection medium onto the sheet material at the flaws detected in the sheet material to determine the location of the flaw with respect to the projected image.

10. The process of claim 9 and further including the step of marking the sheet material at an edge of the sheet material across from a flaw detected in the sheet material.

11. The process of claim 9 and further including the step of cutting across the sheet material on opposite sides of a flaw to remove the flaw from the sheet material and connecting the cut ends of the sheet material.

12. The process of claim 11 and wherein the step of connecting the cut ends of sheet material comprises splicing the cut ends of sheet material.

13. The process of claim 9 and wherein the step of moving a visual image projection medium in timed relationship with the movement of the sheet material comprises moving a visual image projection medium which includes a visual image of a garment pattern and splice marks in timed relationship with the movement of the sheet material, and further including the step of cutting across the sheet material on opposite sides of a flaw to remove the flaw from the sheet material, and splicing the cut ends of the sheet material at locations on the sheet material where splice marks are projected by the visual image projection medium.

* * * * *